United States Patent [19]

Solomon

[11] Patent Number: 4,729,071

[45] Date of Patent: Mar. 1, 1988

[54] LOW-INERTIAL BEAM DIRECTION LIGHTING SYSTEM

[75] Inventor: Dennis Solomon, Yarmouth Port, Mass.

[73] Assignee: Altman Stage Lighting Co., Yonkers, N.Y.

[21] Appl. No.: 926,632

[22] Filed: Nov. 3, 1986

[51] Int. Cl.[4] ..... F21V 21/30

[52] U.S. Cl. ..... 362/35; 362/277; 362/457; 362/458; 350/6.9; 350/6.91

[58] Field of Search ..... 362/35, 457, 458, 277; 350/6.7, 6.8, 6.9, 6.91

[56] References Cited

U.S. PATENT DOCUMENTS

| | | | |
|---|---|---|---|
| 1,961,116 | 5/1934 | Van Braam Van Vloten | 362/35 X |
| 3,420,594 | 1/1969 | Chapman | 350/6.9 X |
| 3,710,098 | 1/1973 | Walden | 362/35 |
| 3,987,296 | 10/1976 | Coppola et al. | 362/277 |
| 4,104,615 | 8/1978 | Hunter | 362/35 X |
| 4,256,364 | 3/1981 | Minoura et al. | 350/6.91 X |
| 4,353,110 | 10/1982 | Ellis | 362/35 |

*Primary Examiner*—Larry Jones

*Attorney, Agent, or Firm*—Lackenbach Siegel Marzullo & Aronson

[57] ABSTRACT

The present invention provides a light display system for projecting a double-pattern light display. A luminaire holding the lamp and light control devices is fixed to a first housing that in turn is nonrotatably mounted mounted to a control bar. A second housing containing a fixed reflector apparatus adapted to receive the light beam from the luminaire is connected to and rotatable relative to the first housing about a first axis. The second housing contains a reflector rotatable about a second axis. The rotatable reflector receives the light beam from the fixed reflector apparatus and projects the beam in a geometric configuration, preferably a vertical plane that contains the first axis. A pan driver attached to the first housing rotates the second housing about the first axis by way of a gear and belt mechanism that is connected to a cylindrical mounting member attached to the second housing. The stationary luminaire directs the light beam through a cylindrical passage in the cylindrical mounting member. A tilt driver attached to the second housing rotates the rotatable mirror about the second axis, which is perpendicular to the first axis. A slip-ring connector connected to the cylindrical mounting member transmits electrical power from the power source to tilt driver. The light beam is thus moved simultaneously about two axes so as to cast a double patterned light on the environment.

23 Claims, 18 Drawing Figures

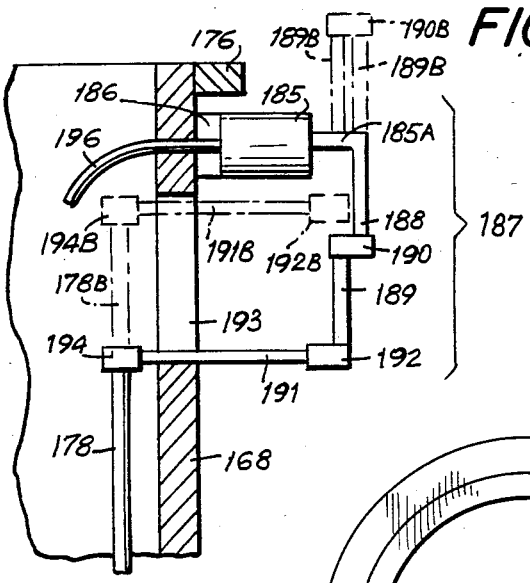
FIG. 8
FIG. 9
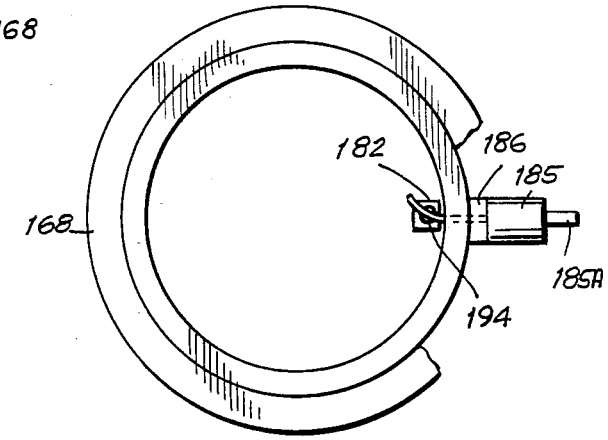
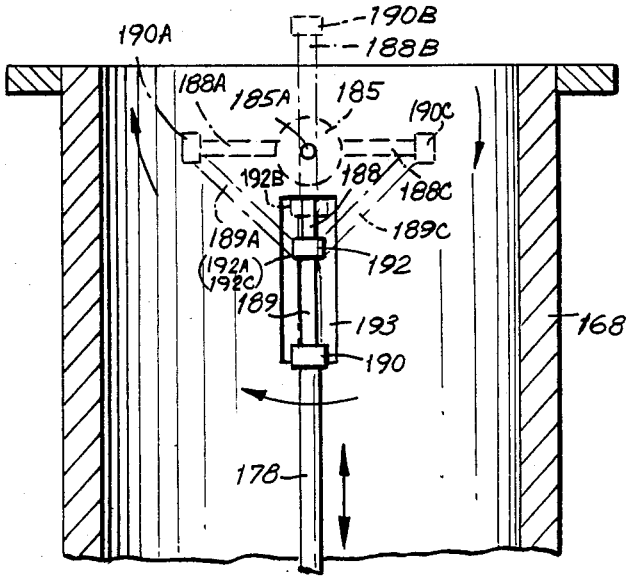
FIG. 10

LOW-INERTIAL BEAM DIRECTION LIGHTING SYSTEM

This invention relates to light projection systems and more particularly to a light display apparatus that projects decorative patterns.

BACKGROUND OF THE INVENTION

Light projection systems used for such purposes as spotlights for theatrical situations such as stage productions and concerts are not adaptable for use in the type of varied light displays required as decorative backgrounds for such environments as popular music concerts or nightclubs. Such decorative displays are intended to create a general illusion or effect rather than to systematically illuminate performers or objects. The light display systems being used are generally projections of a single light beam that is moved in a single projection pattern.

Light beams used to decorate an area are known. The simplest type uses a single mirror that generally is rotated about a single vertical axis. The optical integrity of a single mirror system is limited because to get a constantly moving pattern the mirror must be tilted almost parallel to the incoming rays with the result that some rays will bypass the mirror entirely, which bypassing rays will not rotate but will be stationary, so that the whole moving decorative effect is spoiled.

Another decorative lighting system is known by the trade name of Vari-Lite. This system is described in U.S. Pat. No. 4,392,185. Although a continuously moving light covering substantially a full spheroid by using simultaneous pivotal movement of the light beam over an X-Y axis is achieved, the system is flawed in that the entire luminaire containing the lamp, iris, lens, shutter, color changer, dimmer, and special effects pattern device. The resulting inertial problems of revolving this mass, including power, operational, and cost problems of this system, are not to be minimized.

SUMMARY OF THE INVENTION

It is an object of this invention to provide a multiple mirror lighting system that will illuminate an environment with a constantly moving light that illuminates a wide area in a continuous, simultaneous, double-pattern display, that is, movement of a single light beam on an X-Y axis, with a minimum of inertial mass being rotated.

It is another object of this invention to provide a multiple mirror light display system that can be directed at an area to be decorated by illumination in a continuous double-pattern display that is directed over substantially a full spheroidal volume, and that minimizes inertial impediments caused by the rotating mass by providing a stationary luminaire.

It is another object of this invention to provide a multiple mirror light display system that directs a light beam over a full spherical area without dark spots or nonmoving lighted areas and that has a stationary luminaire.

In accordance with these and other objects, there is provided a light display system for projecting a double light pattern that comprises an upper stable housing, a lower housing connected to and rotatable relative to the upper housing centered about a first axis, a lamp assembly apparatus, or luminaire, mounted in the upper housing for projecting a light beam centered along the first axis, a fixed reflector apparatus fixedly mounted in the lower housing that is for receiving the light beam at the first axis and directing the light beam generally transverse to the first axis, a first drive mechanism connected to the upper housing for rotating the lower housing including the fixed reflector apparatus about the first axis, a rotatable reflector apparatus rotatably mounted in the lower housing for receiving the light beam from the fixed reflector apparatus, the rotatable reflector apparatus being rotatably movable about a second axis generally transverse to the first axis, the rotatable reflector apparatus further being for continuously directing the light beam in a plane emanating from the second axis, and a second drive mechanism for rotating the rotatable reflector apparatus. The lower housing includes a cylindrical mounting member positioned between the lamp assembly and the fixed reflector apparatus, the mounting member having a cylindrical passage axially aligned with the first axis, the lamp assembly apparatus directing the light beam through the cylindrical passage along the first axis to the fixed reflector apparatus. The first drive mechanism is an electric motor that rotates the cylindrical mounting member by way of a pulley gear, a belt drive, and a drive gear mounted to the outer side of the cylindrical mounting member. The fixed reflector apparatus can include one, two, or three mirrors; the rotatable reflector apparatus includes one mirror. The second drive mechanism is an electric motor preferably mounted to the cylindrical mounting member but which can be mounted to the upper housing.

The present invention will be better understood and the main objects and important features, other than those enumerated above, will become apparent when consideration is given to the following details and description, which when taken in conjunction with the annexed drawings, describes, discloses, illustrates, and shows the preferred embodiments or modifications of the present invention and what is presently considered and believed to be the best mode off practice in the principles thereof. Other embodiments or modifications may be suggested to those having the benefit of the teachings herein and such other embodiments or modifications are intended to be reserved especially as they fall within the scope and spirit of the subjoined claims.

The present invention will be better understood and the main objects and important features, other than those enumerated above, will become apparent when consideration is given to the following details and description, which when taken in conjunction with the annexed drawings, describes, discloses, illustrates, and shows the preferred embodiments or modifications of the present invention and what is presently considered and believed to be the best mode of practice in the principles thereof. Other embodiments or modifications may be suggested to those having the benefit of the teachings herein; such other embodiments or modifications are intended to be reserved especially as they fall within the scope and spirit of the subjoined claims.

BRIEF DESCRIPTION OF THE DRAWINGS

The invention will be better understood from the following description of specific embodiments of the invention together with the accompanying drawings wherein similar reference characters denote similar elements throughout the several views, in which:

FIG. 8 is a simplified sectional side view of the tilt motor driving a crank mechanism moving a vertical rack;

FIG. 9 is a top view of the cylindrical mounting member, rack, tilt motor, and slide stabilizers of the mounting member;

FIG. 10 is a sectional side view of the crank mechanism driving the rack;

DESCRIPTION OF THE PREFERRED EMBODIMENTS

Figure 6:
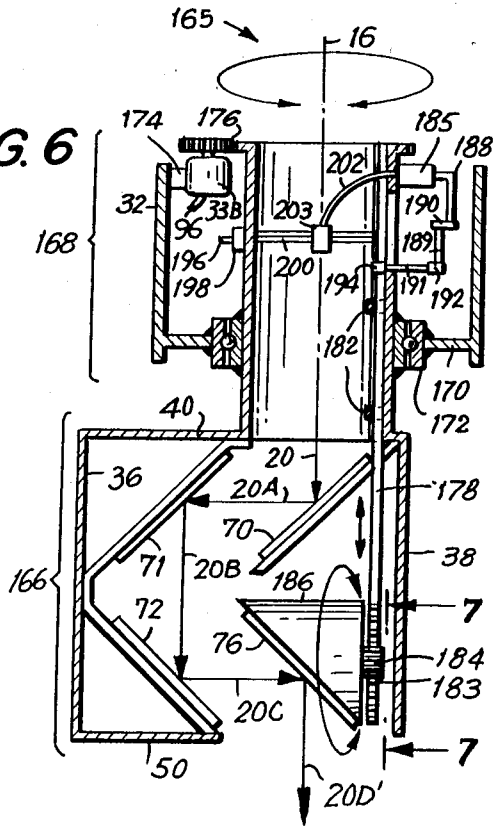
FIG. 6 is still another view of the invention having a vertically movable rotatable reflector to create the second light pattern.

Reference is now made to the drawings and in particular to FIGS. 1–10 in which identical or similar parts are designated by the same reference numerals throughout.

Figure 1:
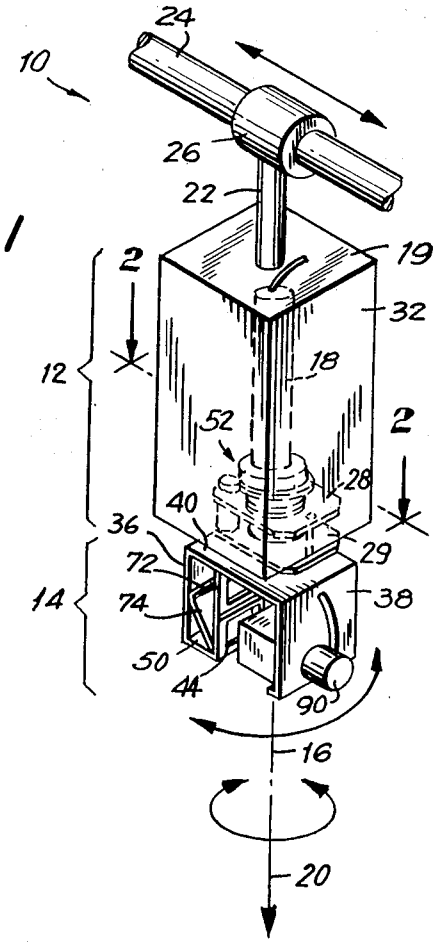
FIG. 1 is a perspective view of the double pattern lighting system shown hung from a mounting bar.
Figure 2:
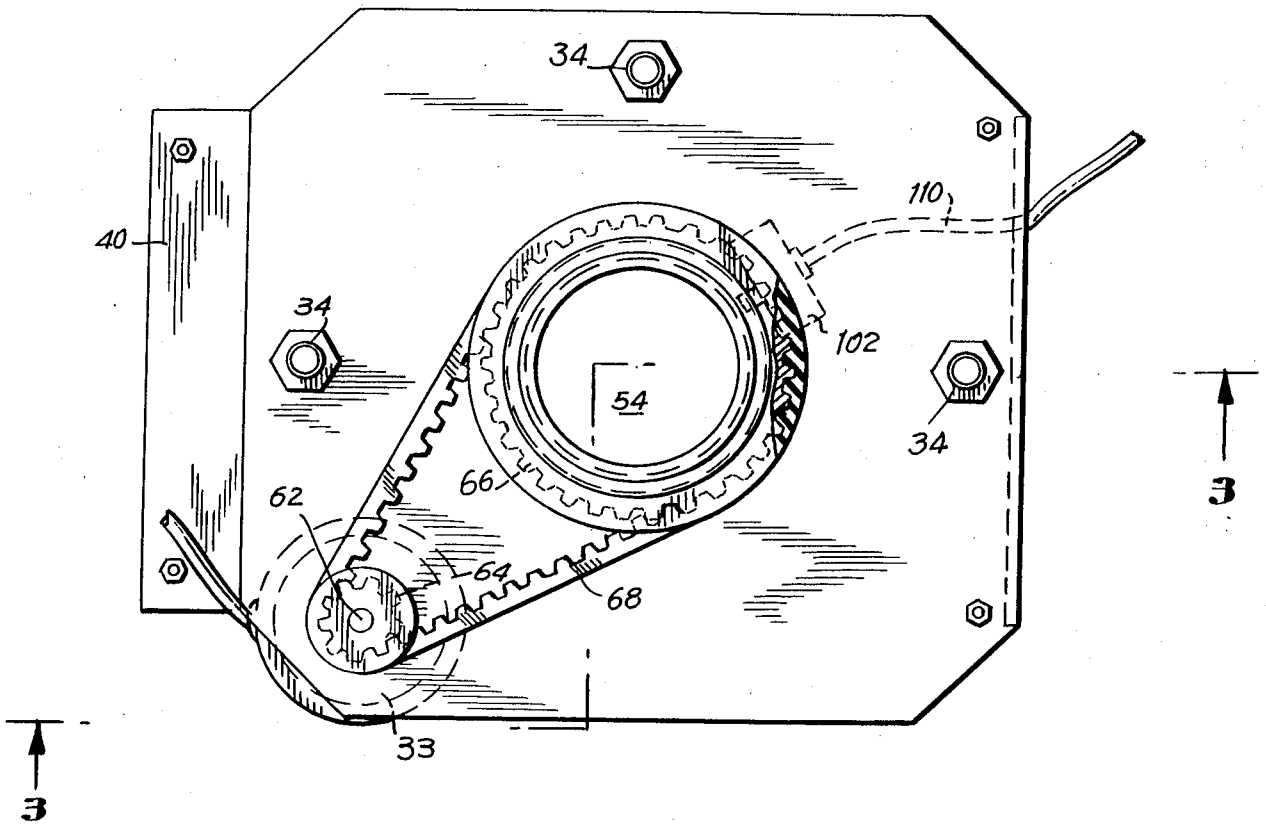
FIG. 2 is a sectional view taken through the plane 2—2 of FIG. 1.
Figure 3:
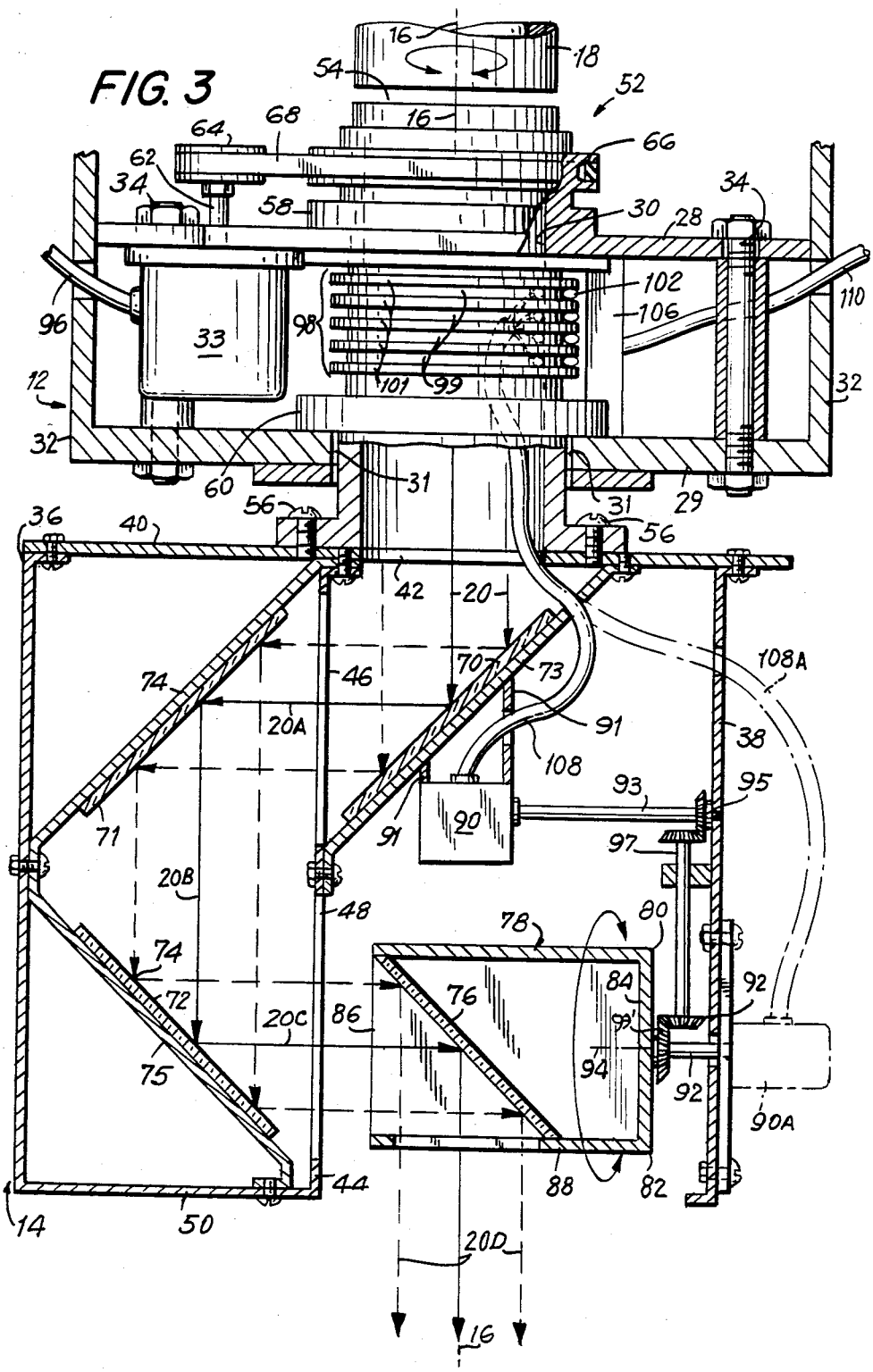
FIG. 3 is a sectional view taken through line 3—3 of FIG. 2.

A light display system 10 shown in FIGS. 1–3 includes a stationary upper housing 12 and a lower housing 14 connected to and rotatable relative to upper housing 12 about a vertical axis 16. A vertically hung, stationary luminaire 18 is mounted in upper housing 12 under the top wall 19. As shown in block diagram in FIG. 15A, a typical luminaire 18 includes a lamp 18A, an iris-pattern 18B, a focus lens 18C, and an optional color changer 18D. The luminaire unit is operable by remote control. A light beam 20 is projected from luminaire 18 centered along an axis 16 in a manner to be described below. A vertical rod 22 secured to top wall 19 connects upper housing 12 to a horizontal bar 24 by way of a gripping ring 26 slidably connected to bar 24. As best seen in FIG. 2 and particularly in FIG. 3, a pair of horizontal, spaced upper and lower support plates 28 and 29, respectively, having circular holes 30 and 31, respectively, are connected at their rectangular peripheries to the vertical side walls 32 of upper housing 12 in a manner known in the art. An electric motor 33 is located between upper and lower support plates 28 and 30 and in particular is mounted to the underside of upper support plate 28. Three vertical bolts 34 aid in keeping plates 28 and 30 in alignment.

Lower housing 14 is generally rectangular and includes a pair of opposed vertical side wall plates 36 and 38 connected by a horizontal top wall plate 40 having a circular hole 42. A vertical plate 44 spaced from side wall plate 36 and having top and bottom apertures 46 and 48, respectively, is bolted to top plate 40 and secured by welding or similar method to a horizontal bottom plate 50 that in turn is connected to the bottom of side wall plate 36 by welding or similar method.

A vertical cylindrical mounting member 52 has a cylindrical passage 54 having an axial center at vertical axis 16 centered on hole 42 and is bolted to top wall plate 40 by a number of bolts 56 through a circular flange extending outwardly from the bottom rim of mounting member 52, which is aligned with the rim of hole 42. Cylindrical mounting member 52 extends through circular holes 30 and 31 of opposed support plates 28 and 29. Upper and lower bearings 58 and 60 are operatively positioned between cylindrical mounting member 52 and support plates 28 and 30 so that lower housing 14 is rotatably supported relative upper housing 12 during rotation of lower housing 14 about axis 16.

As shown in FIGS. 2 and 3, motor 33, which is positioned proximate to cylindrical mounting member 52, has a drive shaft 62 extending vertically upwardly with a connecting pulley 64 that transmits power to a gear 66 positioned around the outer surface of the upper portion of cylindrical mounting member 52 via a drive belt 68. When motor 33 is activated, cylindrical mounting member 52 is rotated thus rotating lower housing 14, which is integral with cylindrical mounting member 52.

Lower housing 14 supports a fixed reflector apparatus that includes first, second, and third tilted mirrors 70, 71, and 72, respectively, each mounted on respective first, second, and third support plates 73, 74, and 75, which are bolted to top wall plate 40, vertical plate 44, and side wall plate 36, and bottom plate 50 at certain angles. First mirror 70 is positioned at a 45° angle with axis 16 and light beam 20 so as to receive light beam 20 from luminaire 18 via cylindrical passage of mounting member 52. Beam 20 is directed at right angles towards side wall plate 36 where the beam, designated as beam 20A, is received by second mirror 71, which is positioned at a 45° angle to beam 20 so as to direct the beam, designated as beam 20B, at right angles downwardly parallel to beam 20 to third mirror 73, which is positioned at a 45° angle relative to beam 20B so as to receive beam 20B and direct the beam, designated as beam 20C, at right angles relative to beam 20B, back towards the center area of lower housing 14. Light beams 20, 20A, 20B, 20C, and, as will be discussed below, light beam 20D are generally cylindrical and centered around axes designated as the light beams. FIG. 3 indicates the general area of the light beam in dotted lines. Subsequent embodiments of the invention indicate only the center axes of the light beam about which the beams are centered.

A rotatable mirror 76 is also mounted in lower housing 14. As shown in FIG. 3, rotatable mirror 76 is positioned at a 45° angle relative incoming light beam 20C in a mirror housing 78 which has opposed horizontally extending walls 80 and 82, respectively, to which the ends of rotatable mirror 76 are attached, and a vertical rear wall 84 attached to horizontal walls 80 and 82. Housing 78 has an open side 86 through which incoming beam 20C passes to rotatable mirror 76. Wall 82 has an aperture 88. Rotatable mirror 76 is so angled relative to incoming light beam 20C that after light beam 20C is received by rotatable mirror 76 the light beam, designated as light beam 20D, is directed from the rotatable mirror at right angles relative incoming beam 20C through aperture 88. As shown in FIG. 3, light beam 20D is axially centered along axis 16 so as to make it continuous with originally projected beam 20. It is noted that having beams 20 and 20D axially aligned is preferable since if beam 20D were offset from beam 20, a non-illuminated area, or dark spot, at the projected area of axis 16 would result. With the configuration shown in FIG. 3, a moving spotlight is continuously moved over over substantially a full spherical area. It is noted that the beam will be interrupted by interference at housing 32 and mounting member 52.

An electric motor 90 is positioned within lower housing 14 at a location generally coaxial with the axis of beams 20 and 20D, which is also the axis of rotation of lower housing 14. In this position motor 90 is generally coaxial with the center of inertia of the rotating mass. Motor 90 is held in place by mounting rods 91 which are connected to mirror support plate 73, but other mounting devices may be used. A horizontal drive shaft 93 connected to the drive shaft of motor 90 extends to a pair of bevel gears 95 which drive a vertical shaft 97 which in turn is connected to another pair of bevel gears 99 which are connected to the horizontal shaft 92 of rotating mirror housing 78. A horizontal drive shaft 92 that is aligned with incoming light beam 20C of motor 90 extends through side wall plate 38 and is mounted to rear wall 84 of rotatable mirror housing 78. When motor 90 is activated, light beam 20D is continuously projected through aperture 88 over a 360° movement. Because light beam 20D is preferably projected at right angles to shaft 92, the geometric pattern projected at right angles projected by light beam 20D is a vertical plane pivoted along axis 16. If another angle of projection rather than the right angle projection of light beam 20D illustrated is selected, another configuration than the vertical plane generated will be generated, with the result that a dark area devoid of light will result directly below axis 16; for this reason a vertical plane is the preferred geometrical configuration. Also, as stated earlier, the vertical plane generated by light beam 20D is preferably aligned with axis 16 so as to avoid an offset dark spot below axis 16. Light beam 20D continues to project away from light display system 10 until it strikes an object in the theatrical environment in which system 10 is located.

An alternate embodiment to motor 90 is shown in phantom lines in FIG. 3 as electric motor 90A, which is secured to the outer side of side wall plate 38 by way of a connecting plate bolted to wall 38. The drive shaft of motor 90A is connected to shaft 92 of housing 78.

When motor 33, which rotates lower housing 14, is activated at the same time motor 90 is activated, light beam 20D is projected by the panning motion of lower housing 14 and the tilting motion of motor 90 so that a double decorative light pattern is created over the walls and objects of the environment in which system 10 is located. That is, the vertical plane over which beam 20D is projected by tilt motor 90 is at the same time being rotated about axis 16 by pan motor 33. Thus, a continuous spotlight is sent over the walls of the environment in an interweaving double decorative pattern that is based upon simultaneous rotations about vertical axis 16 and horizontal axis 94. It is noted that light beam 20D will strike portions of upper and lower housings 12 and 14 when beam 20D extends upwardly so that the decorative light pattern will not strike the environment during movement of beam 20D through those blocked portions of the 360° planar rotation.

Pan motor 33 is stationery and is connected to a source of electrical power by an external conductor 96 via a transformer and a controller (not shown). Tilt motor 90, because it is being continuously rotated along with lower housing 14 by pan motor 33, is electrically connected to the source of electrical power by way of a slip-ring connector assembly 98 that is integral with cylindrical mounting member 52. Slip-ring connector assembly 98 includes a number of cylindrical electrical conductors 99, shown here as for purposes of exposition only, which are made of an electrically conductive material such as graphite and which are isolated from one another by cylindrical nonconductive insulators 101 that extend between the inner and outer surfaces of slip-ring connector assembly 98, which surfaces are integral, or continuous with, the inner and outer surfaces of cylindrical mounting member 52. Four outer connecting brushes 102 held by a brush holder 106 are connected to the source of electrical power via a transformer and a controller (neither shown) by way of an outer conductor 110. An inner conductor 108 extends between tilt motor 90 and four inner electrical contacts 111, which are positioned in cylindrical passage 54 in such a manner that they do not interfere with light beam 20. Tilt motor 90 is thus in continuous electrical contact with the power source even though it rotates along with its electrical contacts 11 and inner conductor 108. Inner conductor 108A is shown electrically connecting alternate embodiment motor 90A. The plurality of separate brushes and electrical contacts, shown as four for purposes of exposition, and the four equal number of graphite rings, provide paths for separate power signals to tilt motor 90 in accordance with instructions entered at the controller by the operator. The direction of rotation of pan and tilt motors 33 and 90 can be programmed to be periodically reversed throughout the operational mode of the system.

Figure 4:
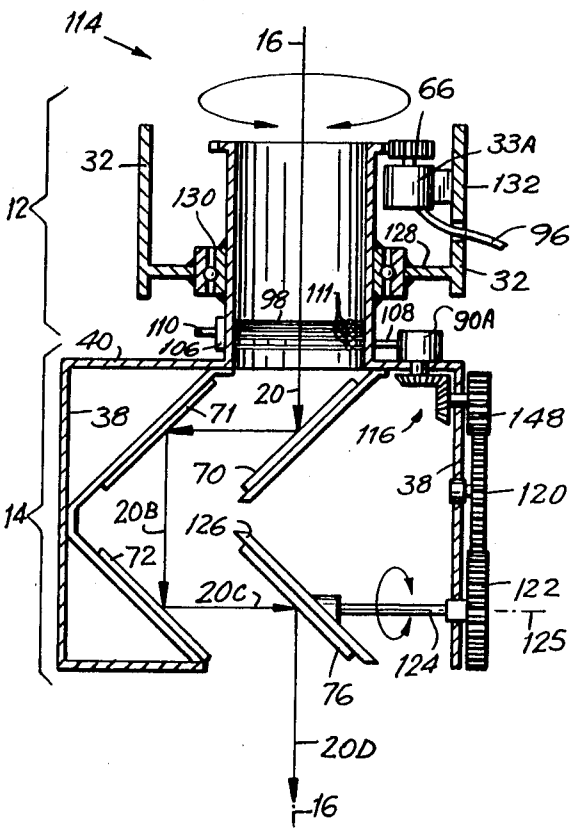
FIG. 4 is an elevational sectional view of another embodiment of the invention having an alternative tilt mechanism.

Another embodiment of the invention is shown in a simplified drawing in FIG. 4 where a light display system 114 having many basic features analogous to the system shown in FIGS. 1–3 includes lower housing 12, cylindrical mounting member 52 with slip-ring connector assembly 52, first, second, and third fixed mirrors 70, 71, and 72, and rotatable mirror 76 are shown. A tilt motor 90A is shown positioned on top wall plate 40 adjacent cylindrical mounting member 40 employs a drive system to rotate rotatable mirror 76. Specifically, a vertical drive shaft 115 of tilt motor 90A extending through top wall plate 40 is connected to a pair of bevel gears 116 the second gear of which drives a pulley gear 118 via a bevel gear drive shaft that extends through side wall plate 38. Pulley gear 118 is attached to a belt 120 that operates a drive gear 122, which rotates a horizontal shaft 124 about horizontal axis 125 and operatively connected to an angled support plate 126 that mounts rotatable mirror 76. It is noted that the embodiment of FIG. 4 uses support plate 126 in lieu of the housing 78 shown in FIG. 3. The embodiment of FIG. 4 also shows a single cross-plate 128 that is secured to side walls 32 of upper housing 12 and which has a hole in which cylindrical mounting member 52 is positioned. Bearings 130 are positioned between the inner periphery of the hole in cross-plate 128 and cylindrical mounting member 52. Pan motor 33A is secured to the inner surface of side wall 32 by a bracket 132. Motor 33A drives cylindrical mounting member 52 and lower housing 14 in the same gear and belt system as does motor 33 shown in FIGS. 1–3.

Figure 5:
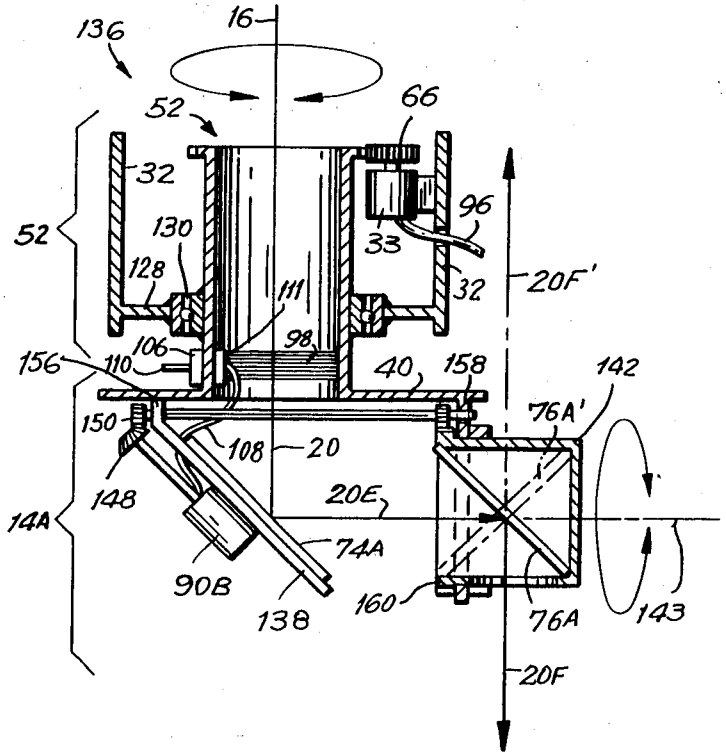
FIG. 5 is yet another elevational view of yet another embodiment of the invention having a second reflector positioned outside the lower housing.

Another embodiment of the present invention indicated as light display system 136 is shown in FIG. 5 with a modified lower housing 14A and cylindrical mounting member 52. Cross-plate 128, pan motor 33A and slip ring 98 are as shown in FIG. 4. Display system 136 includes two features that vary from the features shown in FIGS. 1–3 and FIG. 4.

The first primary distinguishing feature of the embodiment shown in FIG. 5 is that a single fixed mirror 74A with its mirror support 138 is used. Light beam 20 strikes fixed mirror 74A at a 45° angle so as to project the beam as light beam 20E horizontally to rotatable mirror 76A, which receives beam 20E at a 45° angle and projects the beam, shown as beam 20F, in a vertical plane about a 360° rotation. The lower housing 14A includes primarily top wall plate 40 from which fixed mirror support 138 is hung.

The second primary distinguishing feature of FIG. 5 is a rotatable mirror 76A mounted away from upper housing 52 in a cylindrical walled housing 142 rotatable about a horizontal axis 143 aligned with beam 20E. Cylindrical housing 142 positions mirror 76A at a 45° angle relative to beam 20E so that a final beam 20F projected from mirror 76A is rotated over a 360° sweep in a plane parallel with original light beam 20 so that beam 20F is projected through an aperture 144 in housing 142 free of interference by upper housing 12. In FIG. 5 this uninterrupted planar sweep is indicated by rotatable mirror being positioned in position 76A′ as shown in phantom line so that the final beam projects vertically upwards as shown in phantom line as beam 20F′. A tilt motor 90B for rotating housing 142 so as to rotate rotatable mirror 76A is secured to the rear side of fixed mirror support 138. The drive shaft 146 extends along the underside of fixed mirror support 138 to a first bevel gear 148 that engages a second bevel gear 150 of the at a 45° angle with first gear 148. Second gear 150 is secured to a horizontal cross-shaft 152 that is rotatably mounted in suitably journaled brackets 156 and 158 hung from opposite sides of top wall plate 40, bracket 156 being located above fixed mirror 74A and bracket being located above rotatable mirror 76A. A drive gear 154 vertically mounted to cross-shaft 152 opposite second bevel gear 150 engages an external gear 160 fixed to the rim of cylindrical housing 142 that is nearest to fixed mirror 74A so that when tilt motor 90B is activated, cylindrical housing 142 and rotatable mirror 76A are rotated. Cylindrical housing is rotatably mounted with bearing supports in bracket 158, which extends downwardly so as to support cylindrical housing 142. Pan motor 33A, which is mounted in the same manner as tilt motor 33A in FIG. 4, is generally operated simultaneously with tilt motor 90B so that a decorative double pattern is created as the plane of beam 20F is rotated both vertically and horizontally. Direction and speed of rotation can be varied in accordance with programmed instructions at the controller. A conductor 108 connects tilt motor 90B with inner brush holder 102 and its brushes which transmit power from the brushes of outer brush holder 106.

Figure 7:
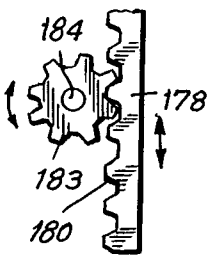
FIG. 7 is a view taken through line 7—7 in FIG. 6.

Another embodiment of the present invention is shown in the simplified cross-sectional drawing shown in FIG. 6, which illustrates a light display system 165 that includes a lower housing 166 similar to lower housings 14 of the embodiments of shown in FIGS. 3 and 4 and three fixed mirrors 70, 71, and 72 and rotatable mirror 76, which are the same as the mirrors shown in the embodiments of FIGS. 3 and 4. Light beams 20, 20A, 20B, and 20C are the same as those described in relation to the descriptions for FIGS. 3 and 4. A cylindrical mounting member 168 is secured to lower housing 166; mounting member 168 is analogous to cylindrical mounting members 52 shown in FIGS. 4 and 5, with differences that will now be discussed. A horizontal supporting cross-plate 170 connected to side walls 32 of the upper housing is rotatably mounted to the cylindrical wall of cylindrical mounting member 168 at circular bearings 172. A pan motor 33B is secured to side wall 32 of the upper housing by a bracket 174. A pulley 176 attached to the drive shaft of the motor acts to rotate cylindrical mounting member 168 and lower housing 166 by way of a drive belt (not shown) and an axial drive gear (not shown) mounted on top of the cylindrical mounting member in a manner similar to that discussed with relation to the embodiments for FIGS. 4 and 5. A vertical rack 178 having teeth 180 on one face, as shown in FIG. 7, is slidably mounted to the inner side wall of cylindrical mounting member 168 by brackets 182. Rack 178 extends downwardly into the interior of lower housing 166 where at the bottom portion of rack 178 teeth 180 are geared with a pinion gear 183 that in turn is fixed to the horizontal axial shaft 184 of fixed mirror support 186.

A tilt motor 185 is secured to the outer side of the upper portion of cylindrical mounting member 168 by a bracket 186 just below pulley 176. Drive shaft 185A of tilt motor 185 drives a crank mechanism 187 connected to rack 178 that acts to raise and lower rack 178 at such a distance that pinion gear 183 is rotated in opposite directions at such a rotational distance that rotatable mirror 76 moves 180° in one direction and then 180° in the opposite direction so that a full 360° sweep of light beam 20D′ is accomplished. Crank mechanism 187 includes a crank arm 188 fixed to the drive shaft of tilt motor 185, a rocker arm 189 movably secured to crank arm 188 by a first link 190 and movably secured to a horizontal drive arm 191 by a second link 192. First link 190 allows movement of rocker arm 189 in a vertical plane relative to crank arm 188 and second link 192 allows movement of rocker arm 189 in a vertical plane relative to drive arm 191. Horizontal drive arm 191 extends through a vertical guide slot 193 formed in the side wall of cylindrical mounting member 168 to a third link 194 that is also attached to the top end of rack 178. Third link 194 allows movement of drive arm 191 in a vertical plane relative to rack 178. Drive arm 191 moves vertically up and down in guide slot 193 in response to the position of crank arm 188, which moves rocker arm 189, which in turn moves horizontal drive arm 191 so as to raise or lower rack 178 at a regular speed. Thus, light beam 20D′ is tilted 180° in one direction then 180° in the opposite direction in a 360° tilt movement. For purposes of exposition, positions of crank mechanism 187 are shown at four positions, from the fully lowered to the fully raised positions of rack 178, the former shown in solid line and three successive positions shown in phantom line. Crank arm 188, rocker arm 189, and drive arm 191 are shown with A,B, and C suffixes at 90°, 180° (fully raised), and 270° positions with first, second, and third links 190, 192, and 191 shown in the same manner in FIG. 9 with rack 178 shown as 178B in its top position. Drive arm 191B and second link 192B positions are seen in FIG. 8. An external conductor 196 is connected to an external brush holder 198 having brush contacts (not shown) in contact with a slip ring 200 integral with cylindrical mounting member 168 at one end and to a power source, including a controller and a transformer (not shown) at the other end. An internal conductor 202 is connected to tilt motor 185 at one end and to an internal brush 203 having brush contacts (not shown) at the other end connected to slip ring 200. Crank mechanism moves rack 178 up and down so that pinion gear 182 acts to rotate fixed housing shaft 184 and thus fixed mirror 76 in two directions so that a final light beam 20D' is directed in a plane parallel to original light beam 20. In this embodiment, light beam 20D' can be rotated less than 360° so as to avoid the interference caused by the upper and lower housings in accordance with the movement programmed for the up and down movement of rack 178 by tilt motor 190. Light beam 20D' is directed in a double pattern when pan motor 33B is being operated so as to rotate the plane of beam 20D'. Light beam 20D' is centered along axis 16 in the same manner as light beam 20D is in FIGS. 3 and 4.

Figure 11:
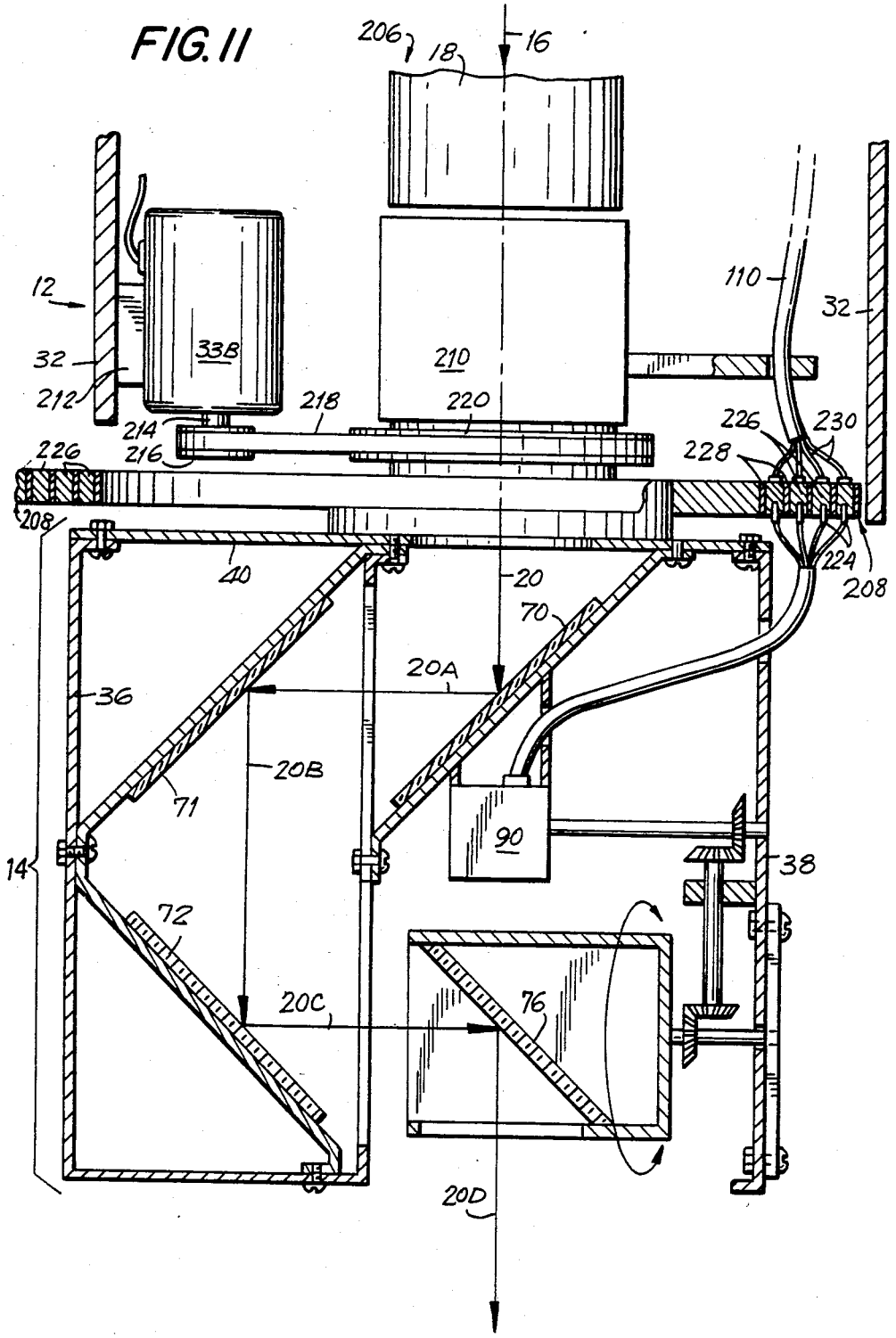
FIG. 11 is a sectional elevational view of the invention with a flat, horizontal slip ring.

FIG. 11 shows a light display system 206 is shown in FIG. 8 that is analogous to light display system 10 shown in FIGS. 1–3. In particular, the lower housing 14 is the same as lower housing 14 of FIGS. 1–3. System 206 includes a flat, horizontal slip ring 208 that is attached to the top of lower housing 14 and thus rotates with lower housing 14. A cylindrical mounting member 210 positioned in upper housing 12, like cylindrical mounting member 52 shown in FIG. 3, has a cylindrical passage (not shown) over which luminaire 18 is situated. A pan motor 33B analogous to pan motor 33 shown in FIG. 3 is secured by a bracket 212 to side wall 32 of upper housing 12. A drive shaft 214 extends vertically downwardly from motor 33B to a pulley gear 216, which is attached to a drive belt 218 in turn mounted to a drive gear 220 mounted around the lower periphery of cylindrical mounting member 210. Conductor 108 from tilt motor 90 extends upwardly to slip ring 208 where a plurality of lower contacts 224 are secured to conductor rings 226, which are surrounded by insulator rings 228. External conductor 110, which is connected to upper external brush contacts 230 that are in electrical contact with the same conductor rings 226 as lower electrical contacts 224, leads to a power source, including a transformer and a controller. Slip ring 208 rotates with lower housing 14 along with motor 90 and lower contacts 224.

Figure 12:
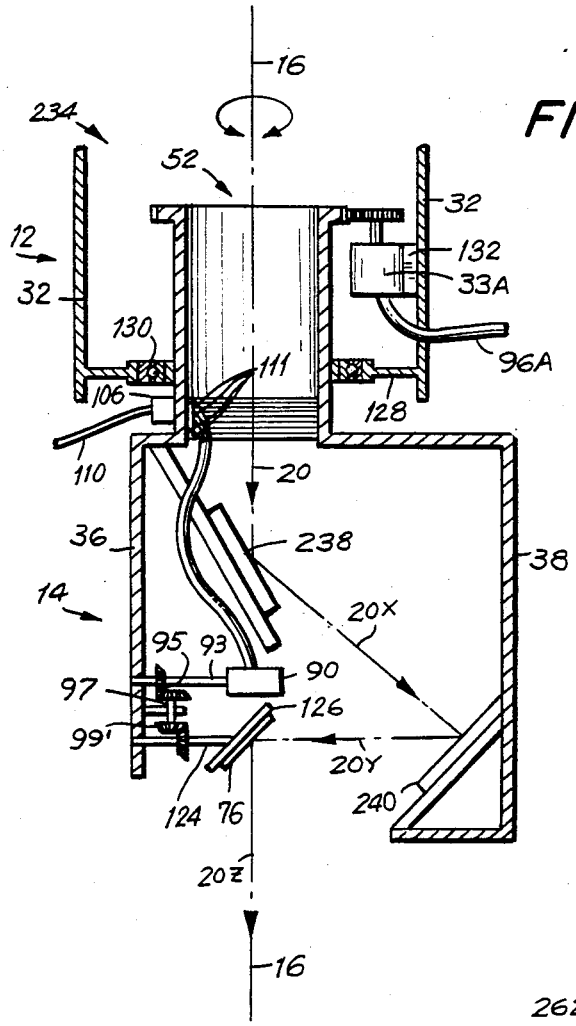
FIG. 12 is an elevational view of an embodiment of the invention having three mirrors.

A three-mirror light display system 234 shown in FIG. 12 includes a cylindrical mounting member 52 with a pan motor 33A like that shown in FIG. 4, and a tilt motor 90 with a drive system like that shown in FIG. 3 including horizontal drive shaft 93, first bevel gearing 95, vertical drive shaft 97, and second bevel gearing 99' driving a mirror mounting 126 holding a rotatable mirror 76 like that shown in FIG. 4. System 234 includes mirrors 238 and 240 fixedly mounted in housing 14. Mirror 238 is secured to a first mirror mount so as to receive light beam 20 and direct it as light beam 20X at an angle to mirror 240 secured to a second mirror mount so as to direct beam 20X as light beam 20Y at right angles to light beam 20 and axis 16 to rotatable mirror 76, which directs the beam in a 360° pattern as light beam 20Z axially aligned with axis 16. Rotatable mirror 76 is mounted to a rotatable mirror mount 126 having a horizontal shaft 124 connected to second bevel gearing 99. In this embodiment light loss from the fourth mirror shown in FIGS. 3, 4, and 6 is eliminated.

Figure 15:
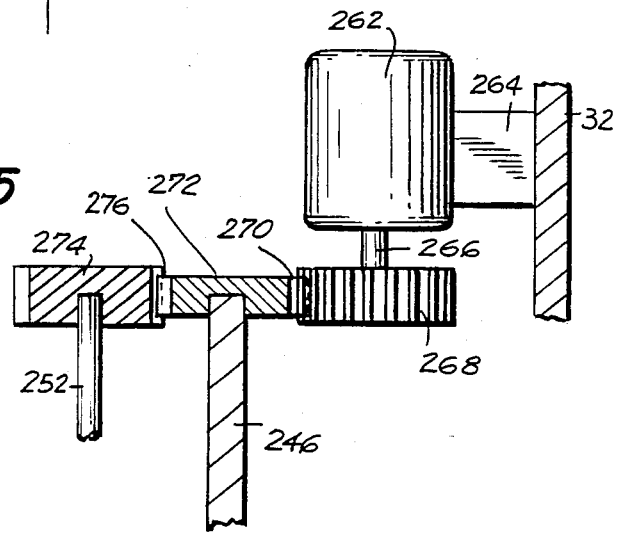
FIG. 15 is a diagram of the gear structure of FIG. 14.
Figure 13:
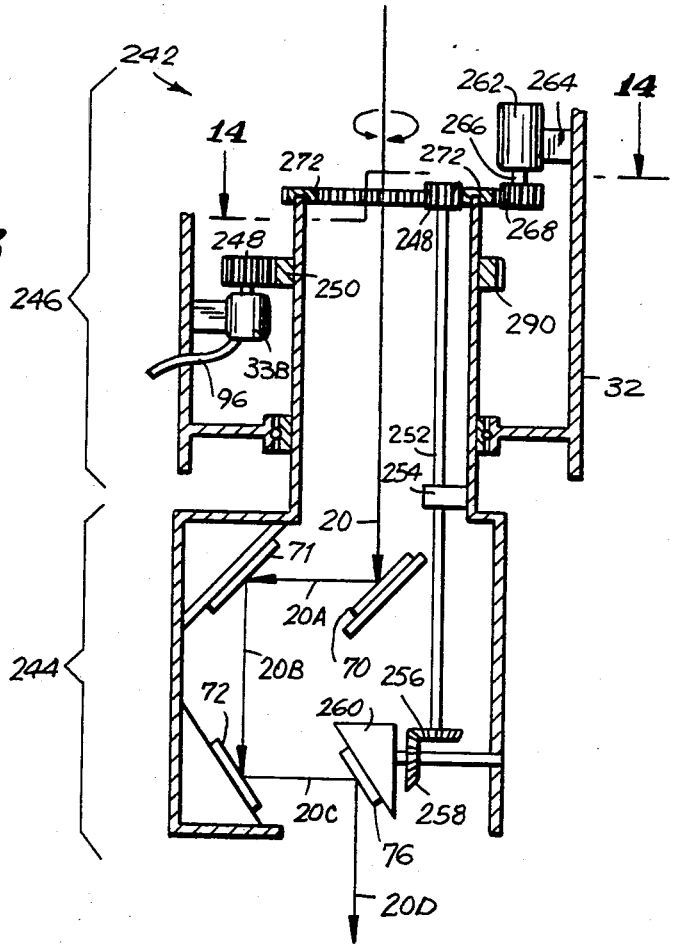
FIG. 13 is an elevational sectional view of another embodiment of the invention.
Figure 14:
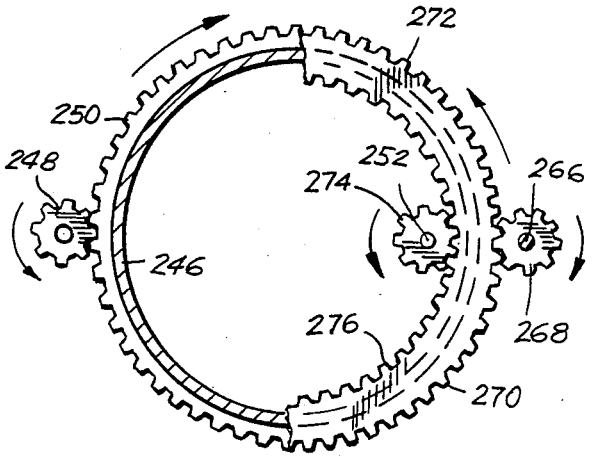
FIG. 14 is a sectional view taken through line 14—14 of FIG. 13.
Figure 15A:
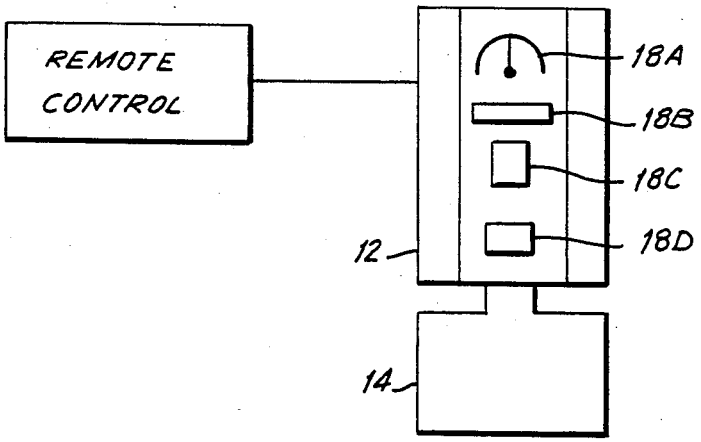
FIG. 15A is a block diagram of the luminaire display system.

FIGS. 13, 14 and 15 illustrate another embodiment of the invention designated as light display system 242 which includes a lower housing 244, a cylindrical mounting member 246 and, a pan motor 33B attached to housing 32 which rotates cylindrical mounting member 246 by gear 248 which meshes with external circular gear of mounting member 246. Light beam 20 is reflected at fixed mirror 70 to light beams 20A, 20B, 20C, and 20D via fixed mirrors 71 and 72 and rotating mirror 76 in a manner analogous to the systems shown in FIGS. 3, 4, 6, and 11. A vertical elongated drive shaft 252 positioned in cylindrical mounting member 246 is rotatably secured to the inner side of mounting member 246 at a bracket 254. The bottom end of shaft 252 is connected to a horizontal bevel gear 256 mated to a vertical bevel gear 258, which turns rotatable housing 260 upon which rotatable mirror 76 is mounted. A tilt motor 262 hung from the inner side of outer housing 32 by bracket 264 has its drive shaft 266 connected to a horizontal drive gear 268 which is geared to the external teeth 270 of a ring gear 272 slidably mounted to the top of cylindrical mounting member 246. The top end of vertical drive shaft 246 is secured to a horizontal shaft gear 274 which is geared to the internal teeth of ring gear 272.

In operation, when pan motor 33B is in operation and tilt motor 262 is not in operation, cylindrical mounting member 246 rotates and in addition, as vertical drive shaft 252 is carried around with member 246, shaft gear 274 is being rotated by internal teeth 276 of ring gear 272, which is kept in a non-rotating mode by the intermeshing external teeth 270 of ring gear 272 and drive gear 268, with the result that mirror 76 is rotated by bevel gears 256 and 258. When tilt motor 262 is operated, drive gear 268 acts to rotate ring gear 272 relative to cylindrical mounting member 246 via external teeth 270 of the ring gear. When the direction of rotation of drive gear 268 is in the opposite rotational direction from pan gear 248, the speed of rotation of shaft gear 252 is increased. When the rotational direction of drive gear 268 is in the same direction as pan gear 248, the speed of rotation of shaft gear 252 is decreased. When drive gear 268 and pan gear 248 are of the same diameter and pan motor 33B and tilt motor 262 are rotating their drive shafts at the same speed, and the direction of rotation of drive gear 268 and pan gear 248 are the same, vertical drive shaft 252 is stationary and mirror 76 does not tilt.

Figure 16:
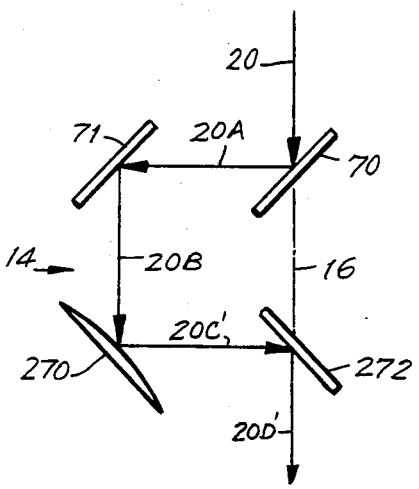
FIG. 16 is a schematic view of a mirror system that includes a convex mirror.
Figure 17:
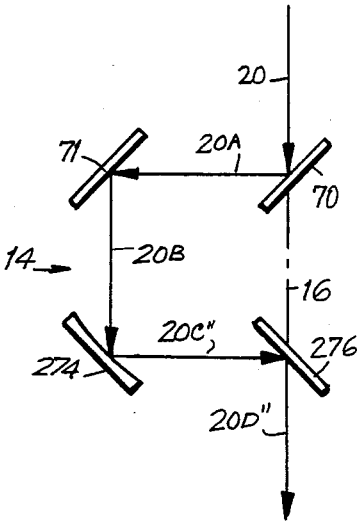
FIG. 17 is a schematic view of a mirror system that includes a concave mirror.

FIGS. 16 and 17 illustrate in schematic form embodiments of the invention that include possible alternate systems. FIG. 16 shows a mirror system mounted in a lower housing 14 containing first and second fixed mirrors 70 and 71 analogous to fixed mirrors 70 and 71 shown in FIG. 3. Mirror 70 directs light beam 20 as light beam 20A to mirror 71. A third mirror 270 fixed in lower housing 14 is convex in configuration and receives a light beam 20B directed from second mirror 71. Convex mirror 270 directs the light beam as a spread light beam centered along a central axis designated as light beam 20C', which is at right angles to axis of rotation 16, to a rotatable mirror 272, which receives the spread beam and directs it along a plane designated as light beam 20D', which is aligned with axis of rotation 16 and beam 20.

FIG. 17 shows a system similar to the one shown in FIG. 16 with light beam 20 being received by a concave mirror 274, which directs a concentrated light beam 20C''' at right angles to axis of rotation 16 to a rotatable mirror 276, which receives the concentrated beam and directs it as light beam 20D" along an axis aligned with axis of rotation 16 and light beam 20. FIGS. 16 and 17 indicate the possibility of complex mirror systems that eliminate the need for any transmissive optical components such as glass lenses.

The embodiment of the invention particularly disclosed and described hereinabove is presented merely as an example of the invention. Other embodiments, forms, and modifications of the invention coming within the proper scope and spirit of the appended claims will, or course, readily suggest themselves to those skilled in the art.

What is claimed is:

1. A light display system for projecting a double-pattern light display, comprising, in combination, a rotatably fixed first housing, a second housing connected to and rotatable relative to said first housing about a first axis, lamp assembly means fixedly mounted in said first housing for projecting a light beam along said first axis, first reflector means fixedly mounted in said second housing for receiving said light beam centered along said first axis and directing said light beam in a direction away from said first axis, first drive means connected to said first housing for rotating said second housing including said first reflector means about said first axis, second reflector means mounted in said second housing and rotatable about a second axis transverse to said first axis, said second reflector means being for receiving said light beam from said fixed reflector means centered along said second axis and for continuously directing said light beam in a plane generally parallel to said first axis, and second drive means connected to said second housing for rotating said rotatable reflector means about said second axis, said second housing having a cylindrical mounting member positioned between said lamp assembly means and said fixed reflector means, said mounting member having a cylindrical passage axially aligned with said first axis, said lamp assembly means directing said light beam through said cylindrical passage along said first axis to said fixed reflector means, whereby only the second housing is rotated thus minimizing inertial forces.

2. The light display system according to claim 1, wherein said lamp assembly system is a luminaire containing a lamp, a lens, an iris, a shutter, optional color changers, and optical control devices.

3. The light display system according to claim 2, wherein said second reflector means includes a rotating mirror which receives said light beam from said first reflector means and reflects said light beam in a plane generally parallel to said first axis when said mirror is rotated about said second axis.

4. The light display system according to claim 3, wherein said first reflector means includes two mirrors fixed to said second housing, one mirror receiving said light beam from said luminaire and reflecting said light beam to the other mirror, the other mirror reflecting said light beam in alignment with said second axis to said rotating mirror.

5. The light display system according to claim 4, wherein said rotating mirror reflects said light beam in a plane which coincides with said first axis.

6. The light display system according to claim 2, wherein said first reflector means includes first, second and third mirrors fixed to said second housing, said first mirror receiving said light beam from said luminaire and reflecting said light beam to said second mirror, which reflects said light beam to said third mirror, which transmits said light beam in alignment with said second axis to said rotating mirror.

7. The light display system of claim 6, wherein said first mirror is positioned at approximately 45 degrees to said light beam at said first axis and which directs said light beam at approximately 90 degrees from said first axis, said second mirror is positioned at approximately 45 degrees to said light beam from said first mirror and which directs said light beam approximately ninety degrees to said light beam from said second mirror and said third mirror is positioned at approximately 45 degrees to said light beam from said second mirror and which directs said light beam approximately 90 degrees to said light beam from said second mirror to said rotating mirror which directs said light beam in alignment with said first axis.

8. The light display system according to claim 6, wherein said rotating mirror reflects said light beam in a plane which coincides with said first axis.

9. The light display system according to claim 2, wherein said first reflector means includes one mirror receiving said light beam along said first axis and projecting said light beam at right angles along said second axis to said rotating mirror.

10. The light display system according to claim 9, wherein said rotating mirror is positioned external to said second housing remote from said first axis, said rotating mirror reflecting said light beam in a plane parallel to and remote from said first axis, said plane bypassing said first housing, whereby said light beam rotates about said plane over 360°.

11. The light display system according to claim 1, further including a slip-ring connector mounted with said cylindrical mounting member, said slip-ring connector having first and second electrical contact surfaces, said light display system further including a source of electrical power and first and second electrical connector means for electrically connecting said first and second drive means, respectively, to said source of electrical power, said second connector means including a first electrical conductor having first electrical contacts means connecting said second drive means with said first surface of said slip-ring connector and a second electrical conductor having second electrical contacts connecting said external surface of said slip-ring connector with said source of electrical power, whereby said second drive means rotates with said second housing about said first axis while keeping in electrical contact with said source of electrical power.

12. The light display system according to claim 11 wherein said slip-ring connector is a cylindrical slip-ring connector integral with said cylindrical mounting member.

13. The light display system according to claim 11, wherein said slip-ring connector is a flat slip-ring connector extending outwardly from said cylindrical mounting member.

14. The light display system of claim 11, wherein said second drive means is a second electric motor connected to said second housing.

15. The light display system of claim 14, further including a shaft generally aligned with said first axis and connected to said fixed reflector mirror, said second electric motor being directly connected to said shaft.

16. The light display system of claim 14, further including a shaft aligned with said second axis and rotatably connected to said second housing, said second electric motor being mounted to said second housing proximate said slip-ring connector, and gear and drive belt means connected to said second housing for transmitting power between said second electric motor and said shaft.

17. The light display system of claim 14, further including a shaft aligned with said second axis and rotatably connected to said second housing, said second electric motor being mounted to said second housing proximate the center of inertia of the rotating mass including said second housing, and shaft and bevel gear means connected to said electric motor and said second housing for transmitting rotational power to said shaft of said rotating mirror.

18. The light display system of claim 11, further including a shaft aligned with said second axis and connected to said fixed reflector mirror, said second motor being mounted to said second housing proximate to said slip-ring connector, a rack positioned transverse to said second axis and slidably mounted to said second housing and having opposed first and second ends, said first end being positioned proximate said second motor and said second end being positioned proximate said rotatable reflector mirror, and a pinion connected to said shaft in operative relationship with said rack; said system further including crank means in operative connection with said second motor and said first end of said rack for moving said rack between first and second positions wherein in said first position said rack rotates said pinion and said shaft in a first rotational direction and in said second position said rack rotates said pinion and said shaft in an opposite rotational direction.

19. The light display system according to claim 1, wherein said first drive means is a first electric motor positioned between and connected to one of said opposed plates of said first housing and gear and belt means connected to said first electric motor and said cylindrical mounting member, said gear and belt means being for rotating said cylindrical mounting member and said second housing upon activation of said first electric motor.

20. The light display system according to claim 1, wherein said first housing includes a pair of opposed, spaced plates positioned generally perpendicular to said axis, said plates having aligned circular apertures, said cylindrical mounting member extending through said apertures, said system including bearing means operatively positioned between said cylindrical mounting member and said opposed plates, said bearing means being for rotatably supporting said second housing relative said first housing during rotation of said second housing.

21. A light display system for projecting a double-pattern light display, comprising, in combination, a rotatably fixed first housing, a second housing connected to and rotatable relative to said first housing about a first axis, lamp assembly means fixedly mounted in said first housing for projecting a light beam along said first axis, first reflector means fixedly mounted in said second housing for receiving said light beam centered along said first axis and directed said light beam in a direction away from said first axis, first drive means connected to said first housing for rotating said second housing including said first reflector means about said first axis, second reflector means mounted in said second housing and rotatable about a second axis transverse to said first axis, said second reflector means being for receiving said light beam from said fixed reflector means centered along said second axis and for continuously directing said light beam in a plane generally parallel to said first axis, and second drive means for rotating said rotatable reflector means about said second axis, a shaft transverse to said second axis and connected to said fixed reflector, said second drive means being connected to said first housing, an elongated drive shaft positioned transverse to said second axis and rotatably mounted in said second housing and having opposed first and second ends, said first end being positioned approximate to said second drive means and said second end being positioned approximate to said shaft, a pair of bevel gears operatively connected to said second end and to said shaft, said second housing including a cylindrical mounting member, a ring gear slidably mounted to said cylindrical mounting member approximate to said second drive means, said ring gear including inner and outer gear teeth, a shaft drive gear connected to said first end of said elongated drive shaft and meshed with said inner gear teeth, and a drive gear connected to said second drive means and meshed with said outer gear teeth, whereby said first and second drive means can be independently operated to rotate said second housing and said elongated drive shaft.

22. The light display system according to claim 21, wherein said first reflector means includes at least one fixed mirror being a convex mirror.

23. The light display system according to claim 21, wherein said first reflector means includes at least one fixed mirror being a concave mirror.

* * * * *